United States Patent [19]

Behun

[11] 4,080,159

[45] Mar. 21, 1978

[54] TILTING PAD STRIPPER FINGER

[75] Inventor: Eugene Behun, Rochester, N.Y.

[73] Assignee: Xerox Corporation, Stamford, Conn.

[21] Appl. No.: 750,100

[22] Filed: Dec. 13, 1976

[51] Int. Cl.[2] ..... B05C 11/00; G03G 13/08

[52] U.S. Cl. ..... 432/60; 271/174; 271/DIG. 2; 219/469; 118/245; 355/3 FU

[58] Field of Search ..... 432/60, 75, 228, 59; 271/174, DIG. 2; 355/3 FU; 219/469, 216; 118/60, 70, 245, 637; 101/425; 100/174

[56] References Cited

U.S. PATENT DOCUMENTS

| | | | |
|---|---|---|---|
| 2,972,767 | 2/1961 | Smith | 100/174 |
| 3,844,252 | 10/1974 | Thettu | 432/60 |
| 3,881,859 | 5/1975 | Hamilton | 432/60 |
| 3,938,950 | 2/1976 | Weiler et al. | 118/245 |
| 3,955,889 | 5/1976 | Ishiguro et al. | 271/DIG. 2 |

*Primary Examiner*—John J. Camby
*Assistant Examiner*—Henry C. Yuen
*Attorney, Agent, or Firm*—Melvin A. Klein

[57] ABSTRACT

Stripping apparatus for stripping copy sheets from oil wetted fuser roll surface. Apparatus including stripping finger supported on oil film through dynamic generation of pressure under bottom pad surface of stripping finger in contact with fuser roll by rotational motion of fuser roll.

1 Claim, 3 Drawing Figures

TILTING PAD STRIPPER FINGER

This invention relates generally to a xerographic copying apparatus and more particularly to an improved stripping apparatus for stripping copy sheets from a wetted heated pressure roll fuser apparatus used to fix electroscopic toner material to paper sheets.

In the process of xerography, the light image of an original to be copied is typically recorded in the form of a latent electrostatic image upon a photosensitive member with subsequent rendering of the latent image visible by the application of electroscopic marking particles, commonly referred to as toner. The visual image can either be fixed directly upon the photosensitive member or transferred from the member to a sheet of plain paper with subsequent affixing of the image thereto.

One approach for fixing or fusing of electroscopic toner particles onto paper support material has been to pass the paper support material with toner images thereon between a pair of opposed roller members at least one of which is internally heated. Occasionally toner particles will be offset to the fuser roll for various reasons. In such a case toner particles may be transferred to the surface of the fuser with subsequent transfer to the backup roll during periods of time when no paper is in the nip. It will be appreciated that these toner particles can then be retransferred to the paper with an accompanying degradation of the quality of copies being produced. For minimizing the offsetting problem a release agent, such as silicone oil is applied to the fuser roll as described, for example, in U.S. Pat. No. 3,256,002.

Current designs of fuser roll stripping fingers have been facing a major challenge in stripping copy bearing a solid area image at the leading edge. In cleaving the paper from the fuser roll, stripping forces can be minimized by having the stripping finger manufactured with a durable tip of very small radius, e.g., equal to or less than ½ mil. Sharp tips of this kind are practical to manufacture and durable only with hard materials such as metal, glass or ceramics. Stripping fingers of this sort have not been acceptable in the current finger configurations because the sharp tip in contact with the roll tends to pierce the relatively soft polymeric coating and effectively destroys the roll. Consequently, the designs have evolved towards materials of much softer nature. The tip radius, however, cannot be maintained under use as the preferred low value. The paper now has a tendency to wedge under the tip and cause a "mis-strip" jam. In an effort to overcome this effect, the normal force holding the finger in contact with the roll has been increased greatly. The paper is no longer capable of lifting the finger but is shocked into releasing from the fuser roll. Albeit paper damage is noted, it is generally at a level below concern. However, fuser roll life is critically limited by the wear under the high unit load imposed by the finger.

This invention is directed towards providing a stripping finger that will not wear the roll and provide reliable operation for the life of the machine, and specifically is an improvement over U.S. Pat. No. 3,844,252 which is commonly assigned with the instant invention.

The principal object of the invention is to provide a new and improved stripping apparatus for stripping copy sheets from wetted pressure heated fusing rolls.

Another object of the invention is to improve the stripping of copy sheets from wetted fusing rolls by a stripper finger supported by a dynamically generated force.

Still another object of the invention is to provide a stripping finger for stripping fused copy sheets from a fuser roll surface wherein the finger will not wear the roll and yet provide reliable operation for the life of the apparatus.

Still another object of the invention is to minimize damage to copy sheets being stripped from a fusing surface without injuring the fusing surface.

Still another object of the present invention is to provide a new and improved stripping finger construction.

Other objects and advantages of the present invention will become apparent when read in conjunction with the accompanying drawings wherein.

Figure 1:
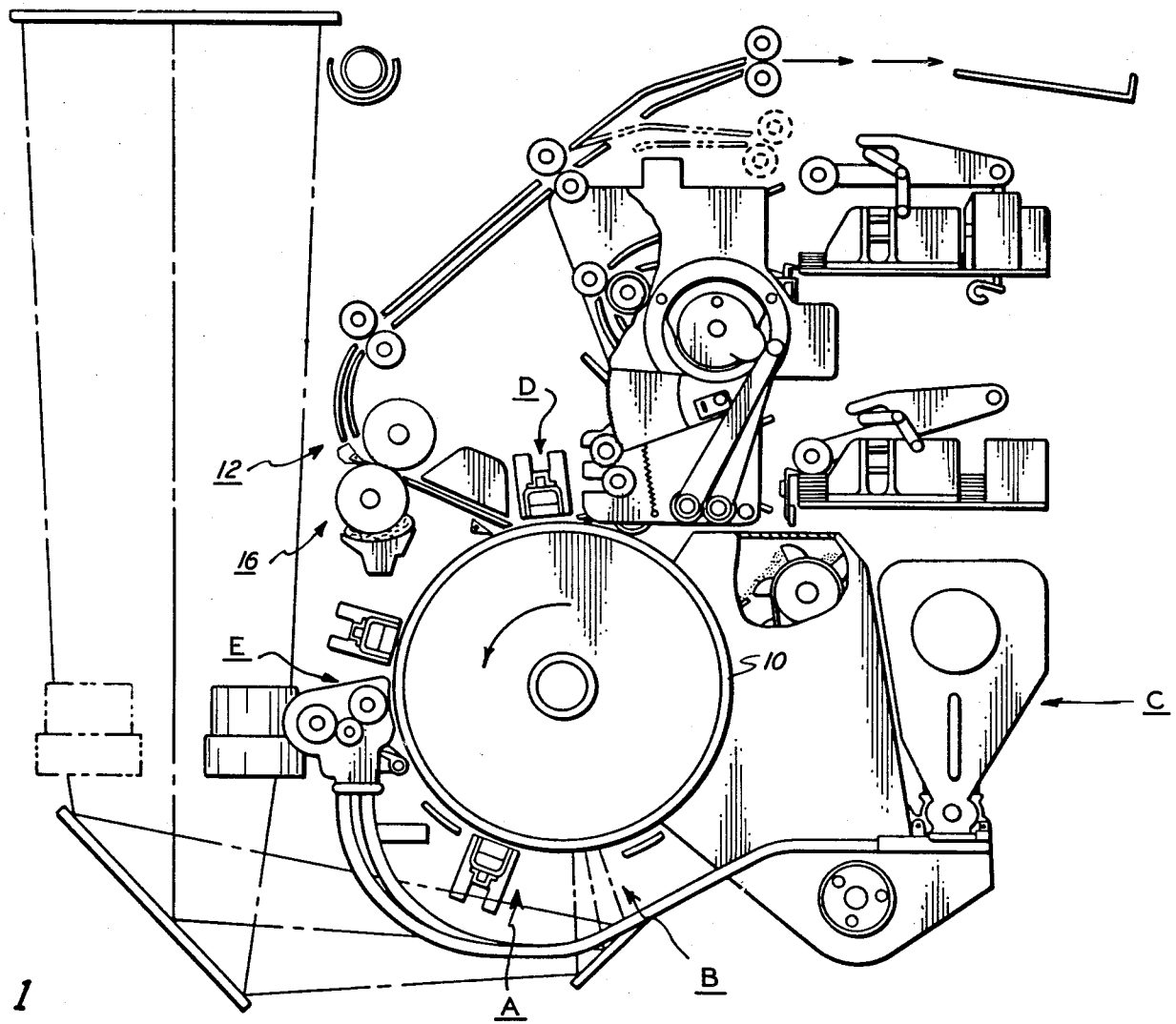
FIG. 1 is a schematic representation of a xerographic reproducing apparatus incorporating the stripping apparatus of the invention.

Referring now to FIG. 1 of the drawings there is shown an embodiment of the invention in a suitable environment such as an automatic xerographic reproducing machine. The automatic reproducing machine includes a xerographic plate or surface 10 formed in the shape of a drum. The plate has a photoconductive layer or light receiving surface on a conductive backing journaled in a frame to rotate in a direction indicated by the arrow. The rotation will cause the plate surface to sequentially pass a series of xerographic processing stations. For purposes of the present disclosure the several xerographic processing stations in the path of movement of the plate surface may be described functionally as follows:

A charging station A which the uniform electrostatic charge is deposited onto the photoconductive plate;

An exposure station B at which light or radiation pattern of copies to be reproduced is projected onto the plate surface to dissipate the charge in the exposed areas thereof to thereby form a latent electrostatic image of the copies to be reproduced;

A developing station C at which xerographic developing material including toner particles having an electrostatic charge opposite to that of the latent electrostatic image is cascaded over the latent electrostatic image to form a powdered image in configuration of the copy being reproduced;

A transfer station D which the powdered image is electrostatically transferred from the plate surface to a transfer material such as paper which is then passed through a heated pressure fusing system having an oil applicating pad and improved stripping apparatus 12 according to the present invention as will be described hereinafter; and A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon.

For further details of the xerographic processing station above reference is made to U.S. Pat. No.

3,645,615, filed July 3, 1969, and commonly assigned herewith.

Figure 2:
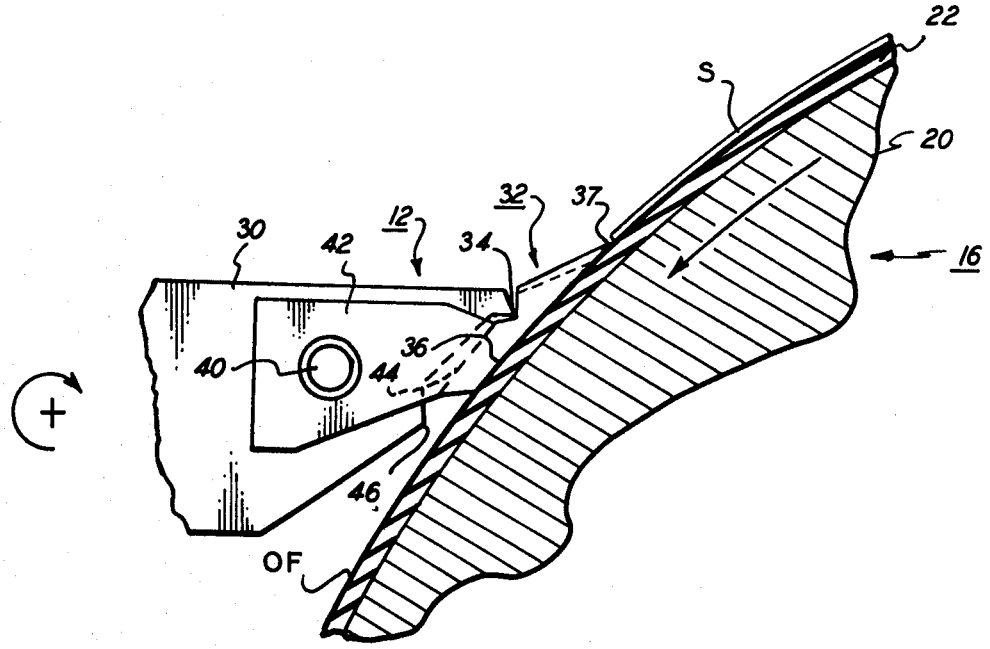
FIG. 2 is a side sectional view of the stripping apparatus of the invention.
Figure 3:
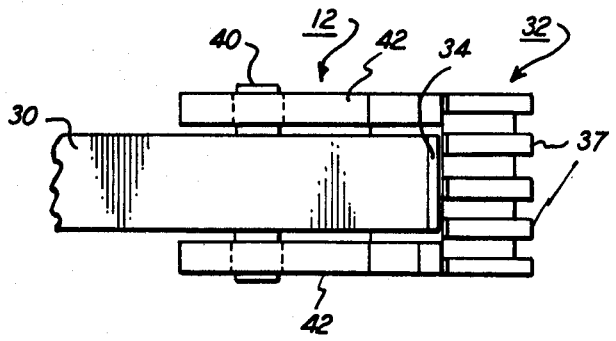
FIG. 3 is a plan view of the stripping apparatus of the invention.

Referring now in particular to FIGS. 2 and 3, there is shown the heated pressure fusing system of the present invention which includes a heated fuser roll 16. Fuser roll 16 is a hollow circular cylinder with a metallic core 20 and a Teflon or like layer 22. Any portable device such as a quartz lamp (not shown) serves as a source of thermal energy and is located at the center of the fuser roll. Power to the lamp is controlled by a thermal sensor generally called a thermister contacting the periphery of the fuser roll as described, for example, in U.S. Pat. No. 3,357,249.

In accordance with the present invention a copy sheet S is stripped from the surface of fuser roll 16 by stripping apparatus 12 without directly contacting the fuser roll surface. Stripping apparatus 12 includes spring loaded arm 30 which pivotally bears on stripping shoe 32 through knife edge 34.

It will be noted that stripping shoe 32 is formed with a bottom surface 36 which is arcuate in shape complementary with the curve of the fuser roll surface. It will be further noted that the distance between the pivot axis at knife edge 34 and the lead edge 37 of stripping shoe 32 is approximately 58% of the arcuate length of shoe 32. The surface 36 is made from a material which is wetted by the oil in order to develop the oil film necessary for proper action. By this structure copy sheet S is stripped from the surface of fuser roll 16 by the stripping action exerted from stripping shoe 32 which rides on an oil film OF on the surface of the fuser roll. Oil film OF supports the bearing load of stripping shoe 32 such that the impact of the stripped copy sheet S does not drive stripping shoe 32 into physical contact with the layer 22 which is delicate and easily damaged.

When removing the fuser roll or the stripping apparatus for service, stripping shoe 32 is conveniently restrained from falling free of the arm 30 by means of a loosely fitted pin member 40 extending from arm 30 and received side extensions 42 of stripping shoe 32. It will be further appreciated that shoulder portion 44 of shoe 32 will be restrained by shoulder portion 46 of arm 30.

While there have been described and shown and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In an apparatus for contact fusing toner particles to paper support material wherein said apparatus comprises fusing roll for applying heat and pressure to the particles and paper support material at a nip through which they are passed and which roll is coated with an oil film to prevent toner offset, an improved stripping apparatus for stripping sheets from the oil wetted fuser roll surface comprising:

stripper finger pad means positioned at the nip exit in close proximity to the moving oil wetted fuser roll surface from which copy sheets are to be stripped, said pad means having a curved shoe surface at the bottom thereof, means for loading said stripper finger pad means against said oil wetted fuser roll surface to strip sheet material therefrom, said means for loading said stripper finger pad means causing a force to be directed transverse to the path of the fuser roll surface at a position slightly greater than half the distance from the leading edge to the trailing edge of the curved shoe surface, whereby relative movement between said shoe surface and fuser roll surface cause hydrodynamic forces to be generated by the moving oil on the fuser roll surface between said shoe surface and the fuser roll surface thereby supporting said stripper finger pad means against the fuser roll surface without physical contact therebetween while stripping copy sheets therefrom, wherein said means for loading said stripper finger pad means includes a knife edge defining a pivot axis positioned at about slightly greater than half of the distance from the leading edge to the trailing edge of the curved shoe surface.

* * * * *